United States Patent [19]

Focke et al.

[11] Patent Number: 4,678,901

[45] Date of Patent: Jul. 7, 1987

[54] OPTICAL SENSOR FOR MONITORING CIGARETTE GROUPS

[75] Inventors: Heinz Focke, Verden; Hugo Mutschall, Kirchlinteln, both of Fed. Rep. of Germany

[73] Assignee: Focke & Co., (GmbH & Co.), Verden, Fed. Rep. of Germany

[21] Appl. No.: 692,469

[22] Filed: Jan. 18, 1985

[30] Foreign Application Priority Data

Feb. 28, 1984 [DE] Fed. Rep. of Germany ..... 3407168

[51] Int. Cl.[4] ..... H01J 40/14

[52] U.S. Cl. ..... 250/223 R; 250/222.1; 131/905

[58] Field of Search ..... 250/216, 221, 222.1, 250/223 R, 223 B, 224, 578; 356/426, 427, 428, 237; 209/536, 586, 587; 131/280, 282–283, 905, 908–910

[56] References Cited

U.S. PATENT DOCUMENTS

| | | | |
|---|---|---|---|
| 3,779,649 | 12/1973 | Bertoya et al. | 356/237 X |
| 4,147,173 | 4/1979 | Reuland | 131/280 |
| 4,209,955 | 7/1980 | Seragnoli | 209/536 X |

FOREIGN PATENT DOCUMENTS

| | | | |
|---|---|---|---|
| 0609796 | 11/1960 | Canada | 209/536 |
| 503343 | 7/1930 | Fed. Rep. of Germany . | |
| 1532268 | 11/1971 | Fed. Rep. of Germany . | |
| 2542082 | 4/1976 | Fed. Rep. of Germany . | |
| 2451760 | 5/1976 | Fed. Rep. of Germany . | |
| 2653298 | 6/1977 | Fed. Rep. of Germany . | |
| 3201666 | 9/1982 | Fed. Rep. of Germany . | |
| 3304299 | 9/1983 | Fed. Rep. of Germany . | |
| 2427067 | 12/1979 | France . | |
| 513764 | 10/1939 | United Kingdom . | |
| 1066056 | 4/1967 | United Kingdom . | |

*Primary Examiner*—Eugene R. LaRoche
*Assistant Examiner*—David Mis
*Attorney, Agent, or Firm*—Sughrue, Mion, Zinn, Macpeak, and Seas

[57] ABSTRACT

During the packaging of cigarettes, cigarette groups (10) assigned to a pack are checked to ensure that all the cigarettes are present. For non-contact monitoring, optical transmitters (22) and receivers (23) are arranged in a support (cantilever 21) located above the path of movement of the cigarette groups (10), in such a way that, when the cigarettes in the top layer (17) are present and properly formed, a check beam (26) from the transmitter (22) is received as a reflected beam (27) by the receiver (23).

8 Claims, 6 Drawing Figures

OPTICAL SENSOR FOR MONITORING CIGARETTE GROUPS

BACKGROUND OF THE INVENTION

The invention relates to a device for monitoring groups of cigarettes oriented in the longitudinal direction (cigarette groups) or of other elongate articles, preferably during transport, by sensing at least one upper layer of cigarettes (top layer), a signal being triggered in the event of a missing cigarette or a defective cigarette.

In the packaging of cigarettes, it is customary to check for defects in both the individual cigarettes and a group of these (cigarette group) to be received in a pack. A first check is carried out from the front or end faces of the cigarettes (head check), specifically usually in the region of a cigarette turret following a cigarette magazine. The cigarette turret serves for forming the cigarette groups or for transferring them to a cigarette conveyor.

The further check, intended particularly for verifying that the complete number of cigarettes is present in a cigarette group, is carried out in the region of the (linear) cigarette conveyor. In this case, the upper layer of the horizontal cigarettes rotating in the conveying direction is sensed (top-layer check). This check has hitherto been executed mechanically, in particular with the use of tracer members (tracer fingers) which as a result of the transport movement of the cigarette group slide along on the upper face of the top layer of the latter. When a cigarette is missing or when there is a defective cigarette, a signal is triggered as a result of the changed relative position of a tracer member.

The abovementioned mechanical top-layer check has disadvantages. On the one hand, the cigarettes are necessarily subjected to mechanical stress. This results in soiling and often even in the destruction of individual cigarettes. Furthermore, this type of cigarette check is unsuitable for high-performance packaging machines, since the tracer members cannot follow the rapid relative movements required and execute uncontrolled jumping movements.

SUMMARY OF THE INVENTION

The invention is primarily concerned with the top-layer check of cigarette groups. Its object is to provide a device for carrying out checks of this kind, which operates faultlessly even on high-speed packaging machines and which also does not result in any damage to the cigarettes.

To achieve this object, the apparatus according to the invention is defined in that the top layer of cigarettes can be sensed free of contact by optical checking means (optical transmitters and receivers).

An optical check of the cigarettes is extremely reliable, because it does not depend on the relative movement of mechanical members. Furthermore, the cigarettes are prevented from being soiled and subjected to mechanical stress.

According to the invention, a checking means is arranged fixed in place above the path of movement of the cigarette groups and is equipped with optical sensors (transmitters and receivers), by means of which an optical control beam is directed onto the cigarettes of the top layer, and receivers arranged offset can be subjected to the beams as result of reflection from the cylindrical surface of the cigarettes. If a control beam is not received by an individual receiver, there is a defective cigarette or there is one missing in the top layer. In reaction to this, a signal is triggered, particularly for the purpose of separating the particular cigarette group from the further packaging process. If a multiplicity of defective cigarette groups is successively identified in this way, the switching off the packaging machine can also be triggered, in order to eliminate the source of the faults.

According to the invention, the checking means consists of a support designed as a cantilever and having a number of transmitters, especially luminous diodes, corresponding to the number of cigarettes in the top layer, and a corresponding number of receivers, especially photo-transistors. The transmitters and receivers are arranged in relation to one another and in relation to the cigarettes in such a relative position that a check beam from each transmitter is directed onto the cylindrical surface of a cigarette assigned to it and is reflected from the latter to the receiver. A luminous spot appears on the cylindrical surface of the cigarette, and because the transmitters and receivers are in an appropriately inclined position it is formed offset laterally in the peripheral direction of the cigarette.

The transmitters and receivers are preferably adjusted to infra-red light. The light or the check beam is appropriately transmitted periodically, especially at a frequency of approximately 5 kHz. Sources of error caused by extraneous light are eliminated as a result. The transmitters and/or receivers are activated only during phases of limited time, in such a way that approximately 95% of the length of the cigarettes is sensed. This makes it possible, on the one hand, to check the cigarettes for possibly missing filter tips. On the other hand, the check beam is not effective outside the cigarettes.

Further features of the invention relate to the constructional design of the checking means and to the arrangement of the transmitters and receivers within the latter.

BRIEF DESCRIPTION OF THE DRAWINGS

An exemplary embodiment of the invention is explained in more detail below with reference to the drawings in which.

DETAILED DESCRIPTION OF THE PREFERRED EMBODIMENT

Figure 1:
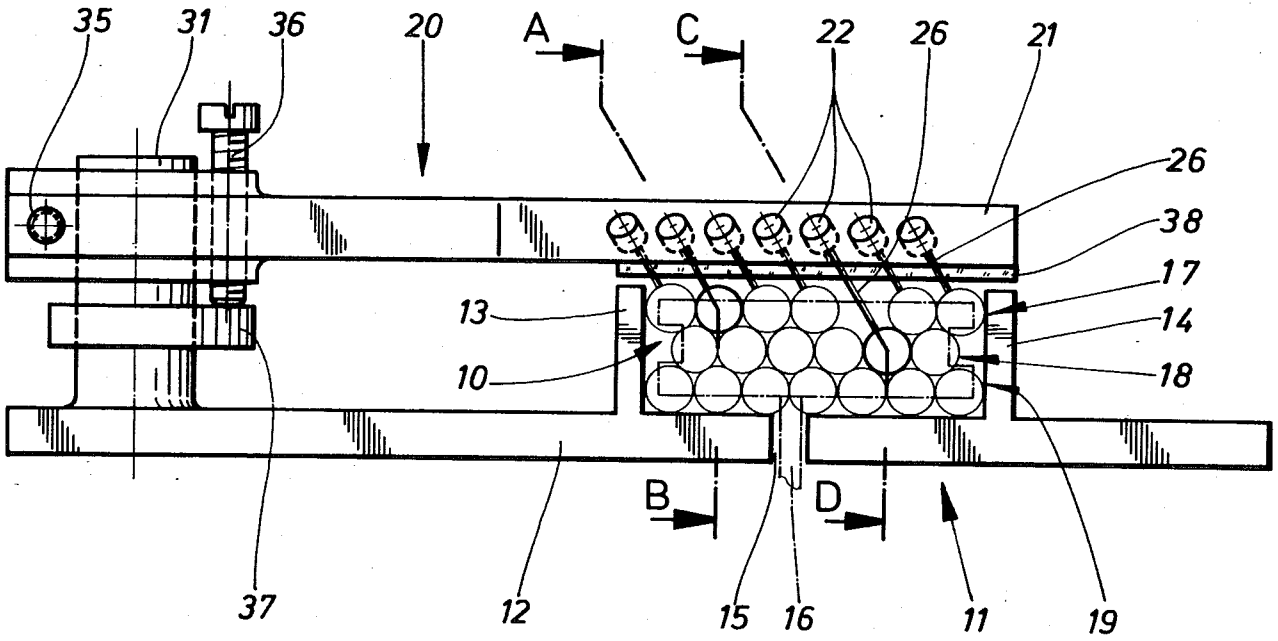
FIG. 1 shows a checking means as a detail in conjunction with a cigarette conveyor, the checking means being seen in a side view.

The exemplary embodiment illustrated in the drawings relates to the monitoring of cigarette groups 10 in conjunction with a packaging machine not shown in detail. The cigarette group has been formed in the region of a preceding cigarette turret (not shown) and is supplied for the actual packaging process by means of a straight cigarette conveyor 11. Here, the cigarette conveyor 11 consists of a base plate 12 as a support for the cigarette groups 10, with side walls 13 and 14. The base plate 12 is provided with a slot 15 which extends in the longitudinal direction and through which passes a pusher 16 of a chain conveyor. The pusher 16 engages the cigarette group 10 on its rear face and conveys it in the longitudinal direction of the base plate 12.

The cigarette groups to be checked in the present case consist of three cigarette layers arranged on top of one another, namely the top layer 17, the middle layer 18 and the bottom layer 19. The above-mentioned layers can be provided with different numbers of cigarettes, depending on the formation of the cigarette group 10. In the example of FIG. 1, the top layer 17 and the bottom layer 19 each have 7 cigarettes and the middle layer 18 has 6 cigarettes. In the exemplary embodiment of FIG. 2, the top layer and middle layer each have 7 cigarettes and the bottom layer has 6.

The cigarette group 10 is conveyed past a fixed checking means 20 by the cigarette conveyor 11. In the present case, this checking means consists of a stationary cantilever 21 which extends above the cigarette conveyor 11 by means of an end region.

Optical sensing or checking means, namely transmitters 22 on the one hand and receivers 23 on the other hand, are accommodated on or in the plate-shaped cantilever 21. Here, the transmitters are luminous diodes emitting infra-red light, and the receivers are phototransistors. The transmitters 22 and receivers 23 are arranged respectively in recesses or bores 24, 25 in the cantilever 21, in such a way that a check beam 26 is directed onto the cylindrical surface of the cigarettes and is guided from this to the receiver 23 as a reflected beam 27.

In the present exemplary embodiment, the transmitters 22 and receivers 23 are arranged in corresponding bores 24, 25, so that the check beam 26 and reflected beam 27 are directed at an angle of approximately 120° relative to one another. At the same time, the longitundinal axes of the bores 24, 25 are directed perpendicularly to correspondingly inclined side faces 28 and 29 of the cantilever 21. As result, the latter acquires a trapezoidal cross-section. The distance between the cantilever 21 and the top layer 17 of cigarettes and the relative position of the transmitter 22 and receiver 23 are selected so that, when a cigarette is present, a light spot 30 is formed on the cylindrical surface of the associated cigarette and runs along on this cylindrical surface according to the conveying movement.

Figure 2:
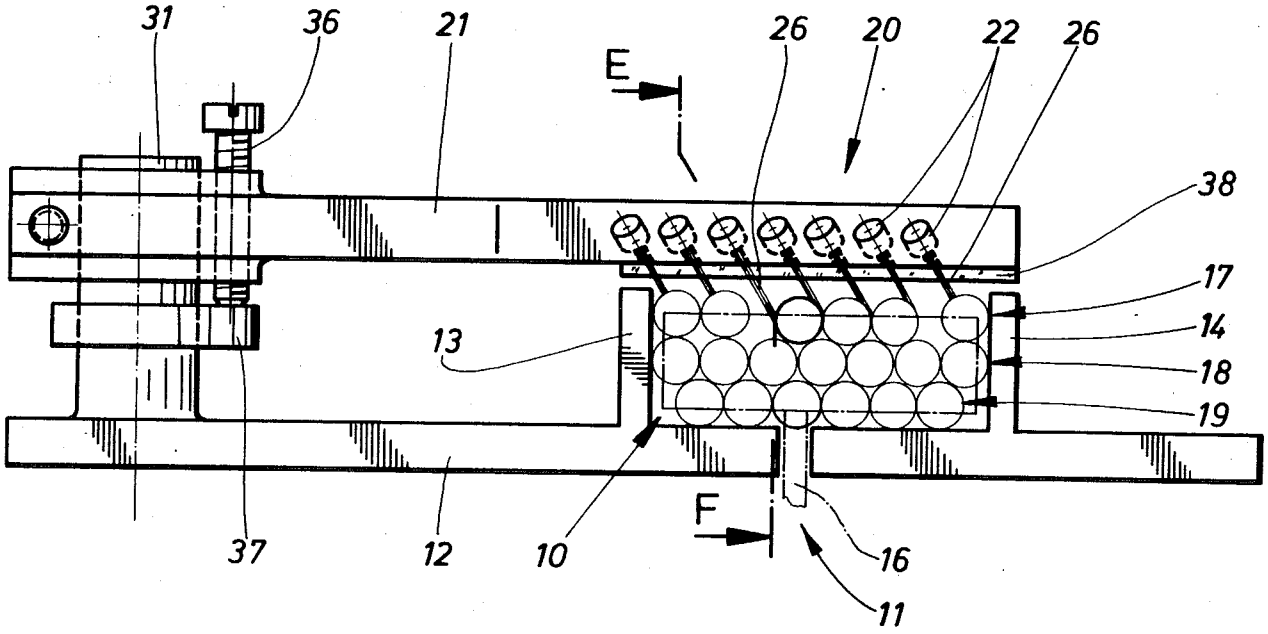
FIG. 2 shows a representation corresponding to that of FIG. 1, with a different fault occurring within the cigarette group.
Figure 3:
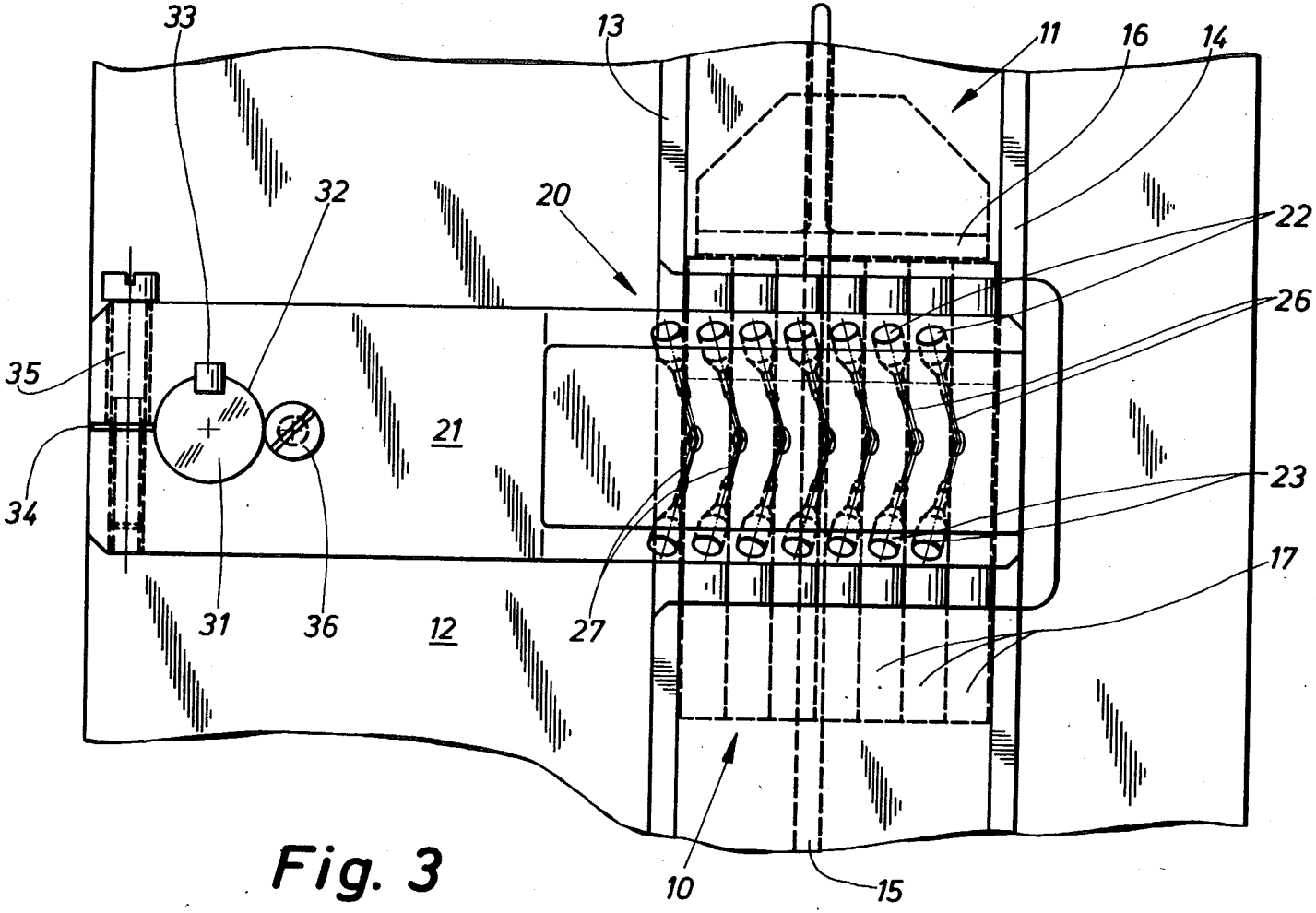
FIG. 3 shows the device of FIGS. 1 and 2 in a horizontal projection.

In the present exemplary embodiment, the longitudinal axes of the transmitter 22 and receiver 23, and of the check beam 26 and reflected beam 27, are directed at an angle to one another not only in a plane parallel to the longitudinal direction of the cigarettes (FIGS. 4, 5 and 6), but also in the plane transverse to this (FIGS. 1 and 2). Accordingly, the longitudinal axes of the transmitter 22 and receiver 23 are not directed vertically from above onto the cigarettes, but are also inclined in a plane transverse to the longitudinal direction of the cigarettes, in particular at an angle of approximately 30° (FIGS. 1 and 2). This ensures that the light spot 30 is formed offset laterally relative to the top side of the cigarettes. The advantage of this is increased responsiveness. The check beam 26 ensures a clearer indication.

Figure 4:
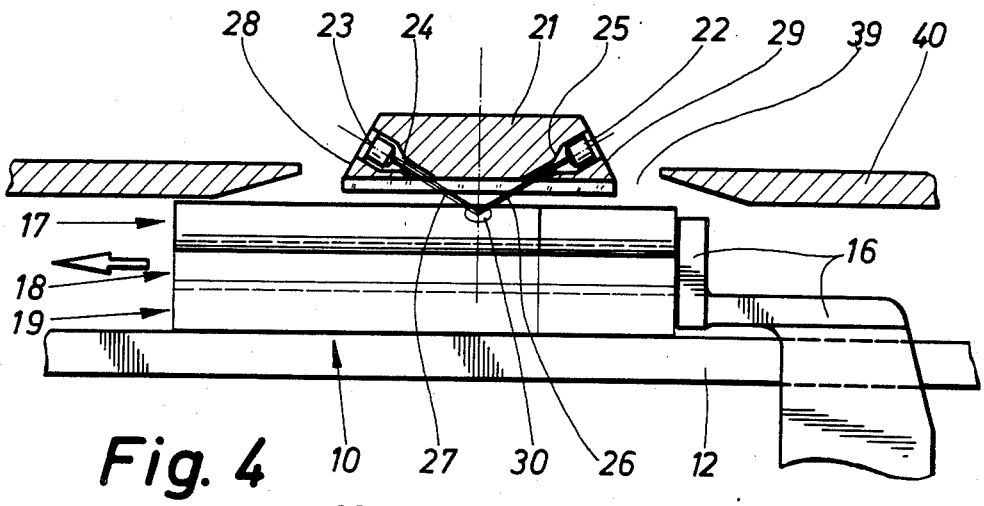
FIG. 4 shows a section A-B from FIG. 1.
Figure 5:
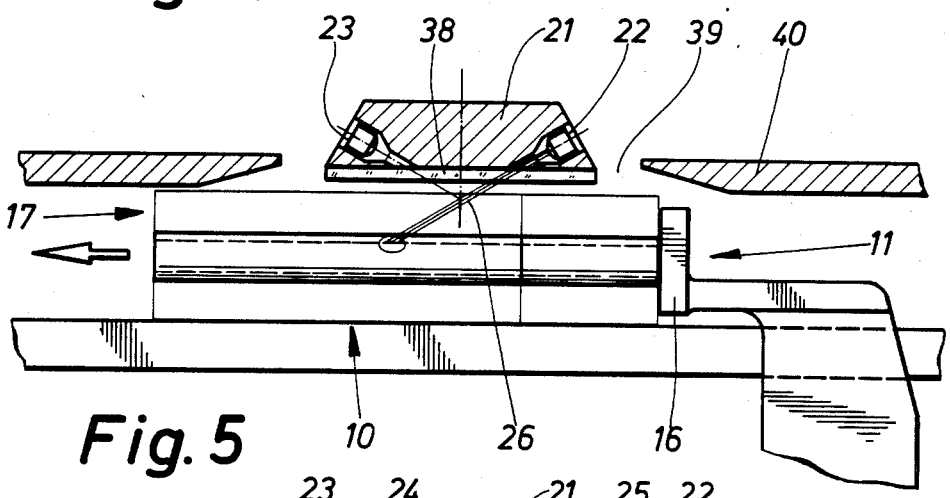
FIG. 5 shows a section C-D from FIG. 1.
Figure 6:
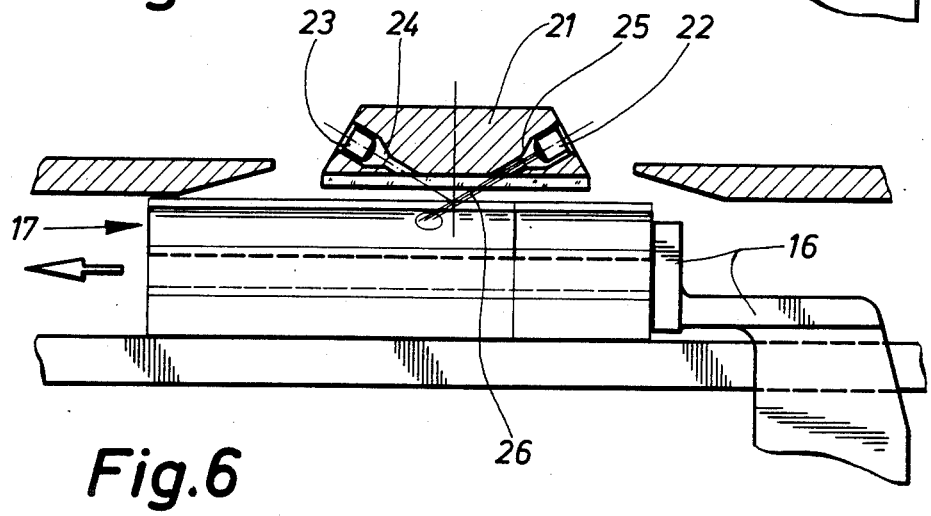
FIG. 6 shows a section E-F from FIG. 2.

With the checking means, defects in the cigarettes groups 10 can be identified in various ways. FIG. 4 Illustrates the sensing of a perfectly positioned cigarette according to the arrangement in the sectional plane A–B of FIG. 1. FIG. 5 shows a situation corresponding to the sectional plane C–D of FIG. 1, that is to say a cigarette group with a cigarette missing in the top layer 17. The check beam 26 is not reflected.

In the exemplary embodiment of FIG. 2, in conjunction with FIG. 6, here again a cigarette is missing in the top layer 17. As result of this, the cigarettes of the top layer 17 and middle layer 18, which originally lay directly on top of one another, partially slip into a transversely offset "saddle position". The resulting offset of the cigarettes again results in the absence of a reflected beam 27.

In the present exemplary embodiment, the cantilever 21 as a support for the transmitters 22 and receivers 23 is mounted laterally next to the cigarette conveyor 11 on the common base plate 12, specifically on a vertical supporting journal 31. This penetrates into a corresponding bearing bore 32 in the cantilever 21. An adjusting spring 33 constitutes a means of preventing rotation. The free end region of the cantilever 21 is designed with a slot 34 which allows the cantilever 21 to be tightened and loosened on the supporting journal 31 in conjuction with a clamping screw 35. When the clamping screw 35 is loosened, the height of the cantilever can be adjusted. An adjusting screw 36 serving to set an exact position passes through the cantilever 21 and by means of its lower end is supported on a fixed stop 37 located on the supporting journal 31.

In the region of the bores 24 and 25 open at the bottom, a transparent cover, in particular a glass pane 38, is attached to the underside of the cantilever 21. The cantilever 21 projects into a gap 39 in an upper wall 40 of the cigarette conveyor 11. Soiling of the bores 24, 25 and of the transmitter 22 and receiver 23 is thereby prevented.

The transmitter 22 is preferably operated with infrared light, specifically periodically at a frequency of approximately 5 KHz. The numbers and relative positions of the transmitter 22 and receiver 23 correspond to the numbers and grouping of the cigarettes to be sensed (top layer 17).

I claim:

1. A device for monitoring the completeness of groups of cylindrical elongated cigarettes being conveyed along a conveying path in a direction parallel to the longitudinal dimension of the cigarettes, each group consisting of at least an upper layer and a lower layer of cigarettes, the upper layer being complete when it has a predetermined number of cigarettes therein arranged side-by-side with their longitudinal axes parallel to one another, said device comprising:

optical scanning means, including a plurality of light transmitters and light receivers, for optically scanning the upper layers of moving groups of cigarettes, without physical contact, with respective check beams which form respective light spots on the longitudinal cylindrical upper surfaces of the cigarettes, the number of said transmitters and the number of said receivers each being equal to said predetermined number; and said receivers being positioned to receive reflected light beams respectively reflected from the cylindrical surfaces of corresponding cigarettes in the upper layers, so that the lack of receipt of a reflected light beam by any one of said receivers causes to be triggered a signal indicative of an incomplete upper layer of cigarettes.

2. A device as claimed in claim 1, wherein a number of luminous diode transmitters (22) corresponding to the number of cigarettes in the upper layer (17) and an equal number of phototransistor receivers (23), each assigned to a respective transmitter, are arranged on a cantilever support (21).

3. A device as claimed in claim 1, comprising a cantilever support (21) which extends transversely over the conveying path of said groups of cigarettes and on which said transmitters and said receivers are supported, and wherein longitudinal axes and beam paths (26, 27) of the transmitters and receivers are directed at an acute angle to longitudinal axes of the cigarettes and at an angle of 60° to a vertical, a conveying plane of the cigarette groups (10) being horizontal.

4. A device as claimed in claim 3, wherein the transmitters (22) and receivers (23) are arranged respectively in inclined continuous bores (24, 25) in the cantilever support (21), starting from correspondingly inclined side faces (28, 29) of the cantilever support (21), such that longitudinal axes of the bores (24, 25) are directed perpendicularly to said side faces (28, 29) and the cantilever support has a trapezoidal cross-section.

5. A device as claimed in claim 1, wherein longitudinal axes of the transmitters (22) and the receivers (23) are directed at an angle relative to one another in a direction transverse to longitudinal axes of the cigarettes, such that the transmitters (22) and receivers (23) assigned respectively to one another are arranged in a V-shaped formation as regards their longitudinal axes and check beams and reflected beams (27), and a light spot from a particular transmitter (22) is incident at a particular point offset relative to the highest point on the top side of the cigarettes.

6. A device as claimed in claim 4, wherein an underside of the cantilever support is provided, in the region of mouths of the continuous bores (24, 25), with a transparent glass cover (38).

7. A device as claimed in claim 6, wherein the cantilever support for the sensors is adjustable in terms of its relative position in relation to the cigarette groups (10), particularly in terms of its height distance, perferably because the cantilever support (21) is arranged on a vertical supporting journal (31) and is supported on a fixed stop (37) via an adjusting screw (36).

8. A device as claimed in claim 7, wherein the cigarettes are sensed by the optical scanning means only over a partial region of their longitudinal lengths, in particular over a length of approximately 90% to 95%.

* * * * *